United States Patent [19]

Hacker

[11] Patent Number: 4,862,566

[45] Date of Patent: Sep. 5, 1989

[54] AUXILIARY DEVICE FOR A SEAM WEAVING MACHINE FOR JOINING THE ENDS OF FLAT-WOVEN FABRICS

[75] Inventor: Haus-Eugen Hacker, Reutlingen, Fed. Rep. of Germany

[73] Assignee: Hermann Wangner GmbH & Co., KG, Reutlingen, Fed. Rep. of Germany

[21] Appl. No.: 251,488

[22] Filed: Sep. 30, 1988

[30] Foreign Application Priority Data

Sep. 30, 1987 [DE] Fed. Rep. of Germany ..... 3733120

[51] Int. Cl.[4] ..... D03D 3/04

[52] U.S. Cl. ..... 28/141

[58] Field of Search ..... 139/1 R, 11; 28/141, 28/142; 289/13

[56] References Cited

U.S. PATENT DOCUMENTS

| | | | |
|---|---|---|---|
| 776,216 | 11/1904 | Butcher . | |
| 2,549,382 | 4/1951 | Mitterway | 289/13 |
| 2,786,256 | 3/1957 | Axelsson | 28/141 |
| 3,885,596 | 5/1975 | Alexeff | 139/11 |
| 4,410,015 | 10/1983 | Koller et al. | 28/141 |
| 4,736,499 | 4/1988 | Kopcke | 28/141 |

FOREIGN PATENT DOCUMENTS 323088 3/1975 Austria .

*Primary Examiner*—Henry S. Jaudon

*Attorney, Agent, or Firm*—Sughrue, Mion, Zinn, Macpeak & Seas

[57] ABSTRACT

An auxiliary device for a seam weaving machine for joining the ends of flat-woven fabrics by a woven seam couples each auxiliary warp thread to a tensioning string. The auxiliary device includes a barbed needle in a guide sleeve with the barbed needle having at one end a barb for seizing an auxiliary warp thread and holding it between the needle and the sleeve. The needle is connected at the other end to a tensioned string. A storage plate is provided having bores for receiving the coupling devices.

4 Claims, 3 Drawing Sheets

AUXILIARY DEVICE FOR A SEAM WEAVING MACHINE FOR JOINING THE ENDS OF FLAT-WOVEN FABRICS

BACKGROUND OF THE INVENTION

The invention relates to an auxiliary device for use with a seam weaving machine serving to join the ends of a synthetic resin fabric flat-woven from longitudinal and transverse threads by forming a woven seam. Such a woven seam is formed from the exposed ends of the longitudinal threads used as weft threads and from the auxiliary warp threads in a weaving operation by means of the seam weaving machine. The auxiliary device serves to couple the auxiliary warp threads to tensioning strings in order to exert the required tension on the auxiliary warp threads required for forming the shed.

In general, transverse threads are used as auxiliary warp threads which are obtained by fraying a strip of the fabric to be provided with a woven seam. Said transverse threads have only limited length, namely a length corresponding to the width of the synthetic resin fabric. The weights used for tensioning the auxiliary warp threads therefore cannot be fastened to the auxiliary warp threads themselves and are fastened to tensioning strings which, in turn, are coupled to the auxiliary warp threads.

Regarding the seaming technique for joining the ends of flat-woven papermachine fabrics reference is made generally to the publication by B. Krenkel in "Das Papier", No. 3, 1984. page 100 et seq. An automatically operating seaming machine for synthetic resin fabrics is described in EP-B-O No. 043 441 where before the beginning of the seam of each papermachine fabric a multiplicity of very closely spaced auxiliary warp threads (up to 448 auxiliary warp threads) are individually tied to or adhered to the ends of the tensioning strings. The tensile force on the individual auxiliary warp threads required for the seam weaving operation ranges between about 70 and 240 N, depending on the type of fabric, and is generally achieved in that each tensioning string end is weighted with a corresponding weight. This tying or adhering of a multiplicity of auxiliary warp threads to tensioning strings is not only very time-consuming but it also brings about the risk of confusion or other imperfections which are not noticed until after weaving and which therefore can be eliminated only with great difficulties later on. If the thread ends are manually adhered or tied together an excessively high tension is easily exerted on the auxiliary warp threads, which may be so high as to cause breakage of the thread.

SUMMARY OF THE INVENTION

Therefore, the invention has the object of providing an auxiliary device for a seam weaving machine by which coupling of the auxiliary warp threads to the tensioning strings is simplified.

According to the invention, this object is realized by a coupling device for coupling each individual auxiliary warp thread to a tensioning string, said device comprising a barbed needle in a guide sleeve, said barbed needle having at one end a barb for seizing an auxiliary warp thread, while the other end is connected to a tensioning string. For coupling the two threads the end of the auxiliary warp thread is placed into the barb and the guide sleeve is pushed over the barb so that the free end of the auxiliary warp thread is folded back and firmly held by friction between the barb and the guide sleeve.

Furthermore, a storage plate is preferably provided which has bores for receiving a coupling device in each bore. The storage plate readies the coupling devices for coupling in a predetermined order so that the operator merely needs to pull them somewhat forwardly out of the storage plate in order to effect coupling to the auxiliary warp threads. The forward end of the guide sleeve facing the barb is widened, for example, to provide a stop in order that the coupling devices will not be pulled through the bores in the storage plate by the weights hanging from the tensioning strings. Preferably, the guide sleeve is provided to this end with lateral flattened portions adjacent the central region and a widened portion inbetween. The lateral flattened portions preferably serve at the same time as guide faces for a barbed needle having a flat shaft of rectangular cross-section.

To prevent the barbed needles from being pulled rearwardly out of the guide sleeves by the tensioning strings coupled thereto, they are preferably provided with a widened or thickened portion adjacent the forward end provided with the barb.

In order to couple the auxiliary warp threads of a fabric to be made endless by forming a woven seam the coupling means disposed in the holes bored along a vertical line in the storage plate are first twisted and aligned so that the longitudinal axes of the flattened portions of the guide sleeves are in alignment. To this end, a tweezers or a similar tool is pushed over the respective vertically spaced guide sleeves, and the two arms of the tweezers are pressed together so that the flattened portions of the coupling sleeves are vertically aligned.

The barbs of the barbed needles are then oriented upwardly or downwardly, but by no means sideways. After this alignment operation, the vertically spaced and aligned coupling means are seized by means of an adapter and are removed from the storage plate. The adapter is shaped as a fork with two parallel prongs spaced apart a distance corresponding to the width of the coupling means at the laterally flattened portions. By means of the adapter, the coupling means are pulled forward about 200 mm away from the storage plate and secured in this position. For initiation of a coupling operation for a particular auxiliary warp thread, the barbed needle is first pushed forwardly so that the barb is exposed. The auxiliary warp thread is placed into the barb, and by pulling the barbed needle at the other end, the latter slides back into the guide sleeve thereby carrying the inserted auxiliary warp thread along. This operation is repeated with all the vertically spaced coupling means seized by the adapter. Then the coupling means are removed from the adapter and take their operative position which is located about 200 mm before the storage plate and in which the tension is transmitted by the tensioning strings to the auxiliary warp threads. By means of the adapter, the next row of superposed coupling means is then seized, and so on.

In order to uncouple the group of auxiliary warp threads after the formation of a woven seam, a major number, preferably the superposed eight of said auxiliary warp threads, are simultaneously pulled out of their guide sleeves and thus uncoupled. The ends of the auxiliary warp threads then drop loosely from the barbs of the coupling means and the individual coupling means are then guided into their initial ready-for-use position in the storage plate.

The advantages attainable by the invention particularly reside in the simple and safe handling of the coupling means, in a substantial saving of time, and in the possibility of handling a plurality of coupling means by a simple fork-like adapter.

DETAILED DESCRIPTION OF THE INVENTION

Figure 1:
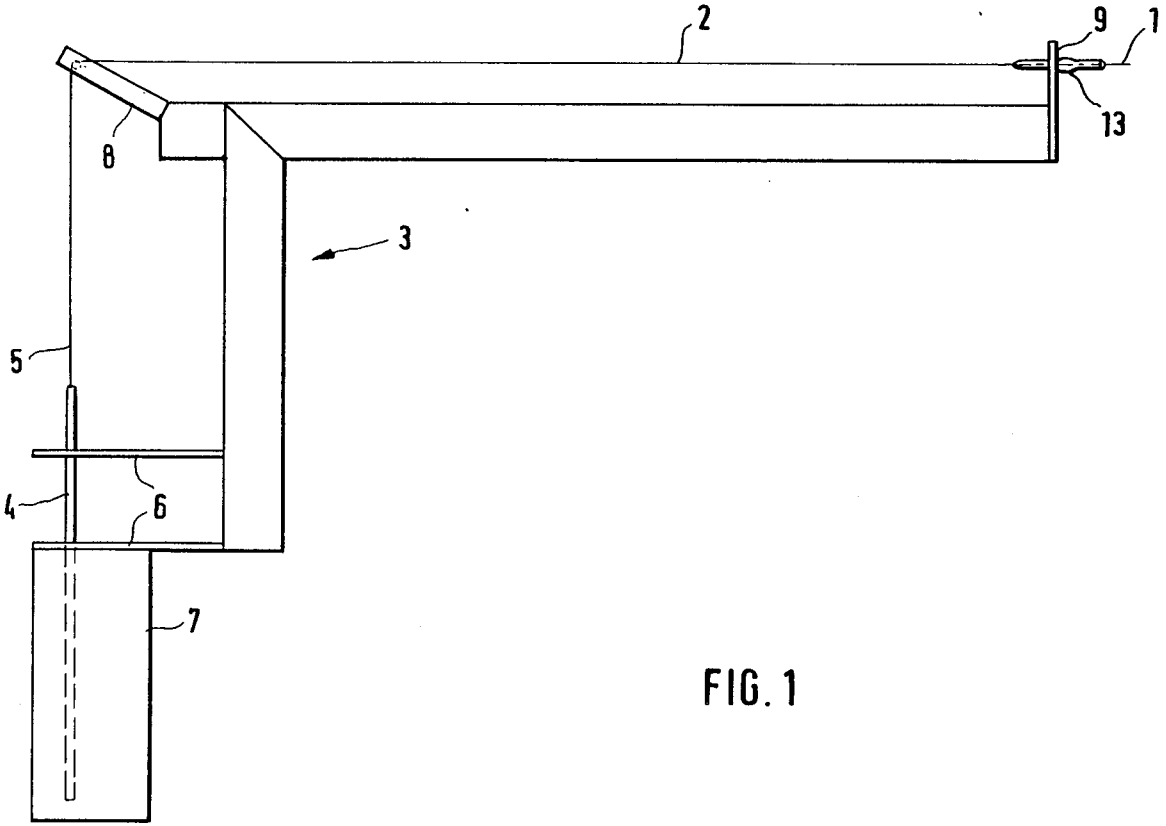
FIG. 1 shows a general view of a portion of a seam weaving machine serving to tension the warp threads.

FIG. 1 shows a portion of a seam weaving machine which produces the required tension for the auxiliary warp threads 1. The tension is transmitted by tensioning strings 2 to the auxiliary warp threads 1, while the auxiliary warp threads 1 and the tensioning strings 2 are linked together by coupling means 13.

A plurality of tensioning strings 2, only one of which is shown in FIG. 1, which are to be coupled individually to an auxiliary warp thread 1 are guided around a cross bar 3 in the form of a gallows and are held under constant tension by weights 4. The weights 4 may have the form of small rods of 12 g mass since up to 448 tensioning strings 2 may be tightened simultaneously. The weights 4 consist of stainless steel and are each provided with an eye on top for threading the associated tensioning string 2. The ends of the tensioning strings 2 are threaded through squeeze tubelets 5 above the weights 4 which are then tightened by clamping. In order to prevent entanglement of the great number of weights 4 and to keep them mobile and in good order, the individual weights are guided through two perforated plates 6 screwed to the cross bar 3 before they are introduced into the weight box 7 provided for protection against external influences.

Each tensioning string 2 weighted down by a weight 4 is diverted to a horizontal plane by a grid 8 of known design and is guided toward a storage plate 9 secured to the front end of the horizontal portion of the gallows-like bar 3. The storage plate 9 has a bore 14 for each tensioning string 2 to be coupled to an auxiliary warp thread 1 for receiving a coupling means 13. In the storage plate 9, the bores 14 are arranged in eight horizontal rows of 56 individual bores each.

Each coupling means 13 includes a guide sleeve 10, having, for example, an external diameter of 1 mm and an overall length of 22 mm for an auxiliary warp thread 1 having a diameter in the range of 0.16 to 0.22 mm. For auxiliary warp threads 1 of a diameter within the range of 0.22 to 0.30 mm a guide sleeve of equal length but of an external diameter of 1.1 mm is used. A needle 11 is located in each guide sleeve 10 and is provided at its leading end with a barb 15 for sizing an auxiliary warp thread 1 and at its rear end with an eye 16 for tying a tensioning thread 2.

The tensile force produced by the weights 4 and transmitted by the tensioning strings 2 to the barbed needles 11 pulls the coupling means 13 into bores 14 in the storage plate 9 which provide seats for rotation of the coupling means 13. The guides sleeves 10 have slightly oval cross sections at both ends, while in the middle they are compressed into a highly oval cross section with lateral flat portions 19, as is apparent from FIGS. 2 and 3. This ensures positive engagement between the bores 14 in the storage plate 9 and the guide sleeves 10 to prevent the sleeves 10 from being pulled through the bores 14.

Figure 2:
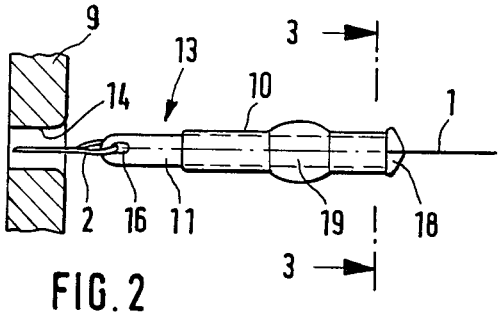
FIG. 2 shows the coupling means with a coupled auxiliary warp thread.

In the coupled state illustrated by FIG. 2, the barbed needle 11 has been drawn rearwardly into the guide sleeve 10 up to the abutment 18. The auxiliary warp thread placed into the barb 15 is pressed between the guide sleeve 10 and the barb 15 as shown in FIG. 3 and the end of the auxiliary warp thread 1 is covered by the guide sleeve 10, i.e. it is invisible and thus cannot interfere with the adjacent auxiliary warp threads 1.

Figure 8:
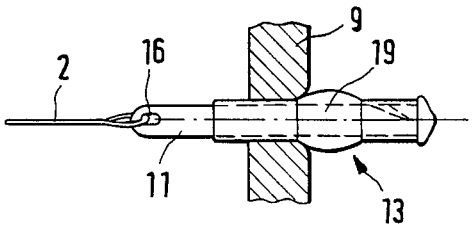
FIG. 8 illustrates the coupling means as applied to the storage plate.

For release or uncoupling of the group of auxiliary warp threads 1, the auxiliary warp threads 1 and needles 11 are simultaneously pulled out of their guide sleeves 10 while the latter are held in position. Thereafter the tension applied by each weight 4 draws the coupling means back into the bores 14 in the storage plate 9, as shown in FIG. 8.

Figure 3:
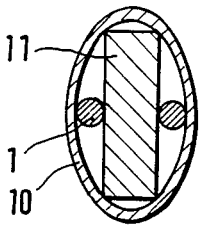
FIG. 3 is a section along 3—3 in FIG. 2.
Figure 4:
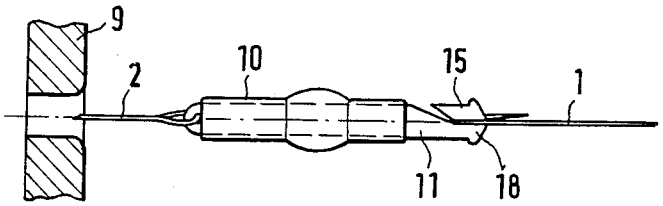
FIG. 4 shows the coupling means of FIG. 2 with the barbed needle extended.

For coupling the individual auxiliary warp threads 1 of a paper machine fabric to be made endless by means of a woven seam coupling means 13 disposed in the bores 14 vertically spaced in rows in the storage plate 9, are aligned with a pair of tweezers or the like so that all the guide sleeves 10 are disposed in the position shown in section in FIG. 3. In this position all the guide sleeves with their pronouncedly dual cross section are in vertical alignment. To accomplish this the tweezers are pushed over the vertically superposed coupling means 13 and compressed so that the pronouncedly oval central portions align themselves in the longitudinal direction of the tweezers. i.e., in the vertical direction. Upon achieving this alignment the barbs 15 of the barbed needles 11 are then automatically aligned in an upward or downward direction but by no means in a lateral direction.

Figure 5:
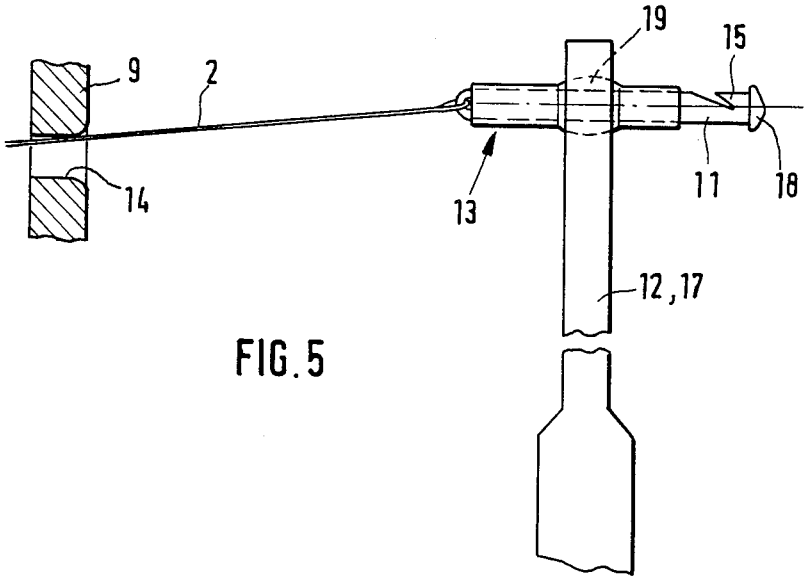
FIG. 5 shows the adapter with a coupling means held therein.
Figure 6:
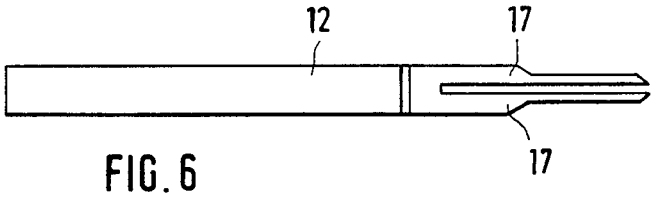
FIGS. 6 and 7 show the adapter in two lateral views rotated 90° relative to one another.
Figure 7:
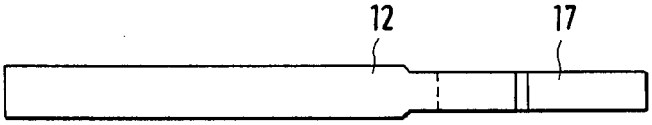

After this alignment operation, the vertically arranged coupling means 13 are seized by means of a fork-like adapter 12 (FIGS. 6 and 7) in that the fork-shaped adapter 12 which is similar to a pair of tweezers, is pushed over the pronouncedly oval central portions of the coupling means 13. By way of the adapter 12, the coupling means 13 in a single row of eight are then removed from the storage plate 9, and the adapter 12 together with the coupling means 13 held between its two arms 17 is held in an adapter seat some distance, e.g. 200 mm, away from the storage plate 9; see FIG. 5. The relative position of said guide sleeve 10 and barbed needle 11 is initially the same as shown in FIG. 2, i.e. the barbed needle 11 is pushed fully back into the guide sleeve 11 so that the widened head 18 of the barbed needle 11 abuts against the forward end of the guide sleeve 10 Each barbed needle 11 is then pulled out of the guide sleeve 10 so that the barb 15 becomes accessible (see FIG. 5) and now the auxiliary warp thread 1 to be coupled is placed into the barb 15. By the application of tension at the rear end of the barbed needle 11 the latter is again pulled into the guide sleeve 10 carrying along the inserted auxiliary warp thread 1, the coupling means 13 is no longer pulled back into the storage plate 9 by the tensioning string 2 and remains at a point shortly behind the adapter position. The location of this point depends on the length of the free ends of the auxiliary warp thread 1 extending from the end of the papermachine fabric which is to be joined to the other end by a woven seam.

After this coupling operation is completed for all the vertically spaced coupling means 13 held by the adapter 12, said coupling operation is repeated by means of the adapter 12 for the next row of vertically spaced coupling means 13, and so on, until all the auxiliary warp threads 1 required for a woven seam are coupled to tensioning strings 2.

The use of an adapter 12 is not required in each case. The coupling means 13 can also be seized singly by hand in order to couple them to the auxiliary warp threads 1. Moreover, the central portions of oval cross-section are not necessary. Slipping of the coupling means 13 through the storage plate 9 can be prevented, for example, also by forming the bores 14 as shoulder bores widened in front, or by providing the coupling means 13 with an external bead at the leading end. Instead of the widened heads 18 at the leading ends of the barbed needles 11, the barbed needles can have a smaller dimension at the rear ends in the region of the eyes 16 so that they bear against a constriction at the rear ends of the guide sleeves 10. In that case it is not necessary that the barbed needles 11 have a rectangular cross-section.

What is claimed is:

1. An auxiliary device for a seam weaving machine for joining the ends of flat-woven fabrics wherein said auxiliary device is adapted to couple a plurality of auxiliary warp threads to a plurality of tensioning strings, said auxiliary device comprising coupling means for coupling each auxiliary warp thread to each tensioning string, said coupling means including a barbed needle slidably disposed in a guide sleeve, said barbed needle having at one end a barb for seizing an auxiliary warp thread and frictionally securing the warp thread between said barb and said sleeve and at the other end connection means for the tensioning string wherein each barbed needle has a flat shaft of rectangular cross-section and each guide sleeve has flattened lateral portions for guidance of the shaft.

2. An auxiliary device according to claim 1, further comprising a storage plate having a plurality of bores for receiving respective coupling means.

3. An auxiliary device according to claim 1, wherein each guide sleeve is further flattened between the laterally flattened portions to form a stop for engaging the storage plate against the tension exerted by the tensioning strings.

4. An auxiliary device according to claim 1 wherein said one end of each barbed needle is widened to prevent the barbed needle from being pulled by a tensioning string through the guide sleeve.

* * * * *